US007882798B2

(12) United States Patent
Lin et al.

(10) Patent No.: US 7,882,798 B2
(45) Date of Patent: Feb. 8, 2011

(54) KEY CAP PAINTING TOOL

(75) Inventors: Chin-Hung Lin, Taipei County (TW); Chao-Lung Chang, Miaoli County (TW); Yung-Nien Chai, Tainan (TW)

(73) Assignee: Darfon Electronics Corp., Taoyuan (TW)

( * ) Notice: Subject to any disclaimer, the term of this patent is extended or adjusted under 35 U.S.C. 154(b) by 609 days.

(21) Appl. No.: 11/907,914

(22) Filed: Oct. 18, 2007

(65) Prior Publication Data

US 2008/0092809 A1 Apr. 24, 2008

(30) Foreign Application Priority Data

Oct. 20, 2006 (TW) ..... 95218524 U

(51) Int. Cl.
*B05B 15/04* (2006.01)

(52) U.S. Cl. ..... 118/500; 269/329; 269/58; 29/281.1

(58) Field of Classification Search ..... 269/315, 269/69, 54.4, 58, 329; 118/500; 29/281.1
See application file for complete search history.

(56) References Cited

U.S. PATENT DOCUMENTS 4,137,623 A * 2/1979 Taylor ..... 29/433
4,200,272 A * 4/1980 Godding ..... 269/26
4,815,712 A * 3/1989 Kawada ..... 254/89 H
5,127,359 A * 7/1992 Kannari et al. ..... 118/56
2003/0188961 A1* 10/2003 Obara et al. ..... 200/344

* cited by examiner

*Primary Examiner*—Parviz Hassanzadeh
*Assistant Examiner*—Charles J Capozzi
(74) *Attorney, Agent, or Firm*—Birch, Stewart, Kolasch & Birch, LLP

(57) ABSTRACT

A spray painting tool for painting key caps is disclosed, which comprises: a platform, having a plurality of columns formed on a top surface of the same; a panel, having a plurality of holes formed thereon at positions corresponding to the plural columns for allowing the plural columns to pass through the panel therefrom; a diaphragm, disposed on the panel while aligning a plurality of holes formed thereon with the plural columns for allowing the plural columns to pass through the diaphragm therefrom; and at least a holding unit, each being arranged on the panel at a position corresponding to one of the plural column for fixedly securing a key cap. As the diaphragm can be easily replaced, the spray painting tool can be used repetitively without worrying the stacking of residue paint on its panel. Moreover, as the spray painting tool is simple in structure and ease to use, painting key caps can be achieved with lower cost and less time.

7 Claims, 4 Drawing Sheets

KEY CAP PAINTING TOOL

FIELD OF THE INVENTION

The present invention relates to a key cap painting tool, and more particularly, to a spray painting tool with diaphragm by which as the low-cost diaphragm can be easily replaced, the spray painting tool can be used repetitively without worrying the stacking of residue paint on its panel, and moreover, as the spray painting tool is simple in structure and ease to use, painting key caps can be achieved with lower cost and less time, so that it is adapted to manufacture keyboards for computers, cellular phones, personal digital assistants (PDAs) or the like.

BACKGROUND OF THE INVENTION

Keyboards, being the input devices widely used in various electronic apparatuses, such as computers, cellular phones and PDAs, usually have their key caps being manufactured by plastic injection molding. However, after each key cap being injection molded, it usually required to be painted for providing the same with different appearances and colors as specified by customers. Recently, keys with scissors-shaped frames are vastly used in computer keyboard for such key has advantages, such as long stroke, good tactile sensation, low noise and long lifespan, etc. Nevertheless, for painting such keys with scissors-shaped frames, it is common to dispose key caps of such keys on a tool which is structured simulating a keyboard structure and is substantially a spray painting platform having a panel disposed thereon. As the panel is provide for scissors-shaped frames to be secured thereon while allowing the key caps to mount fixedly on the scissors-shaped frames, the key caps can be elevated by protruding columns formed on the platform for preparing the key caps for spray painting. After the spray painting, the whole platform with scissors-shaped frames mounted with key caps is to be processed by posterior processes, such as baking, printing, etc., and then the key caps are removed from the scissors-shaped frames. The most significant drawback of the aforesaid conventional spray painting tool is that: residue paint is going to adhere on the panel in each spraying and after several spraying, a stacking of residue paint is going to formed on the panel and thus the panel must be replaced, thereby, not only the cost is increased, but also as the replacing of such panel requires each and every scissors-shaped framed to be dismantled from the old panel and then to be installed on a new panel, a great amount of time is wasted and thus delaying the paint spraying process.

SUMMARY OF THE INVENTION

In view of the disadvantages of prior art, the primary object of the present invention is to provide a spray painting tool with diaphragm by which as the low-cost diaphragm can be easily replaced, the spray painting tool can be used repetitively without worrying the stacking of residue paint on its panel, and moreover, as the spray painting tool is simple in structure and ease to use, painting key caps can be achieved with lower cost and less time.

To achieve the above object, the present invention provides a spray painting tool for paint key caps, comprising: a platform, having a plurality of columns formed on a top surface of the same for elevating key caps; a panel, having a plurality of holes formed thereon at positions corresponding to the plural columns for allowing the plural columns to pass through the panel therefrom; a diaphragm, disposed on the panel while aligning a plurality of holes formed thereon with the plural columns for allowing the plural columns to pass through the diaphragm therefrom; and at least a holding unit, being arranged on the panel at a position corresponding to the plural columns for fixedly securing the key caps.

Preferably, the panel is covered completely by the diaphragm.

Preferably, the diaphragm is made of a plastic selected from the group consisting of polyethylene terephthalate (PET), polyethylene (PE), polyvinyl chloride (PVC), polypropylene (PP), polystyrene (PS) and the like.

Preferably, the holding unit is a scissors-shaped connecting structure, which comprises: a first connecting part and a second connecting part; wherein the bottoms of the first and the second connecting parts are pivotally connected to the panel while the tops of the first and the second connecting parts are pivotally connected to the key caps in a detachable manner.

Preferably, the bottoms of the first and the second connecting parts are pivotally connected to the panel in a detachable manner.

Preferably, the plural protruding columns are mounted on an interlocking element in a manner that the plural columns are driven to descend in synchronization with the descending of the interlocking element.

Preferably, the interlocking element is installed on an elastic member for enabling the interlocking element to resiliently reciprocate between a press position and a release position so that when the interlocking element is descending to the press position, the plural columns are driven to descend in synchronization with the descending of the interlocking element, and when the interlocking element bounces back to the release position by the elastic member, the plural protruding columns are raised to protrude out of the platform.

Preferably, the elastic member is a device selected from the group consisting of a spring, a reed and the combination thereof.

Preferably, the plural columns are electrically connected to a control circuit for allowing the control circuit to control the raising/descending of the plural columns.

Preferably, the control circuit is electrically connected to a driving device for allowing the driving device to control the activation of the control circuit.

Preferably, the driving device is a device selected from the group consisting of a pneumatic device, a hydraulic device and the combination thereof.

Preferably, the key caps are adapted for a keyboard structure of a device selected from the group consisting of a computer, a cellular phone, and a personal digital assistant (PDA).

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention and wherein.

DESCRIPTION OF THE EXEMPLARY EMBODIMENTS

For your esteemed members of reviewing committee to further understand and recognize the fulfilled functions and structural characteristics of the invention, several exemplary embodiments cooperating with detailed description are presented as the follows.

Figure 1:
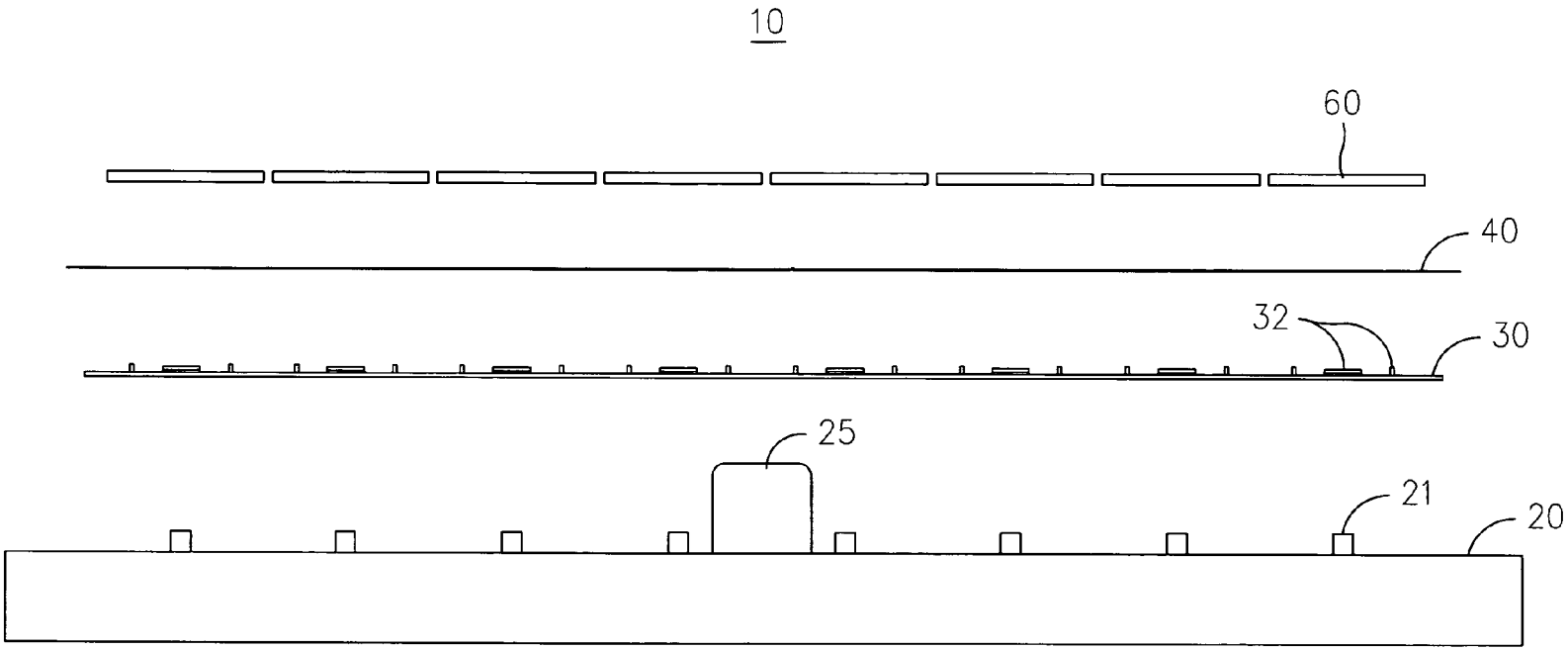
FIG. 1 is an exploded view of a key cap painting tool according to an exemplary embodiment of the invention.
Figure 2:
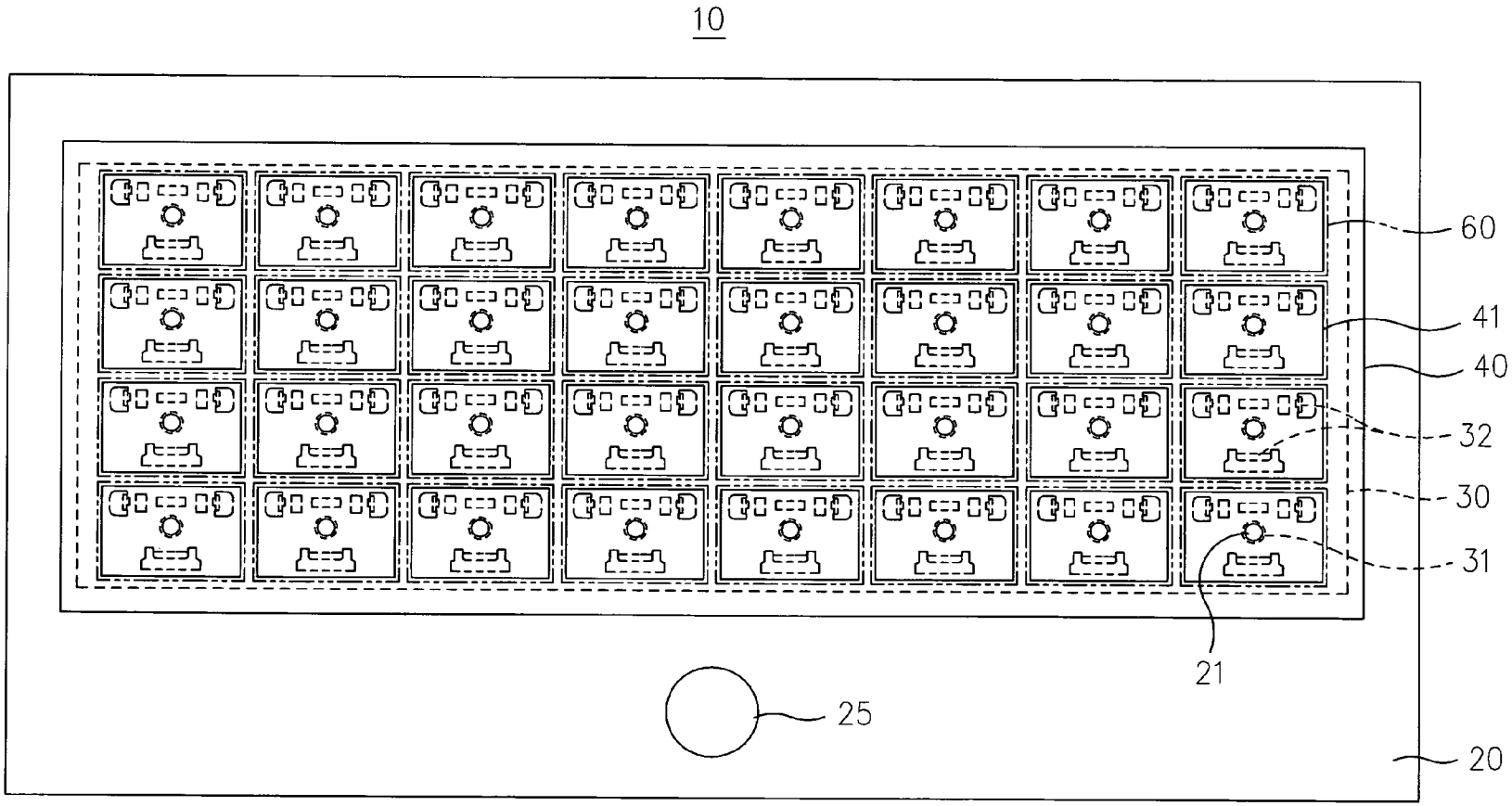
FIG. 2 is a top view of a key cap painting tool according to an exemplary embodiment of the invention.
Figure 3:
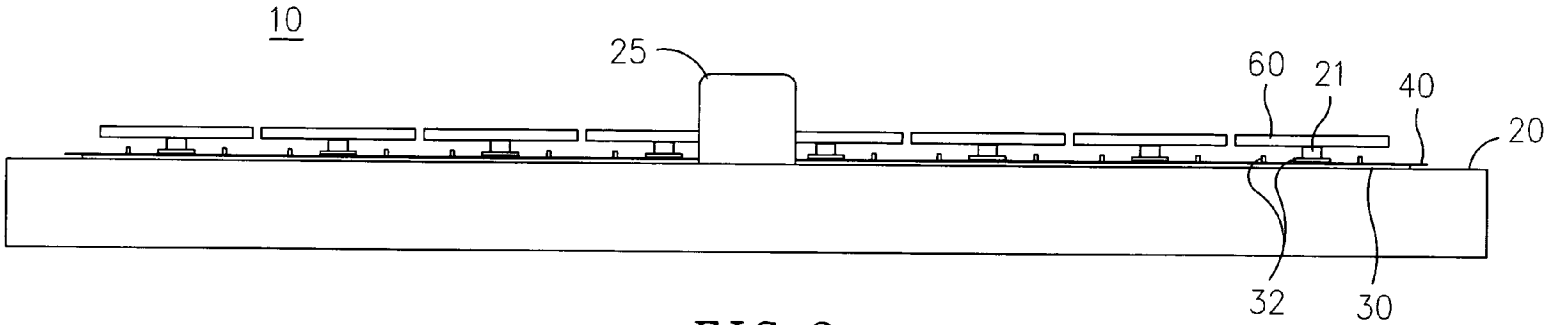
FIG. 3 is a front view of a key cap painting tool according to an exemplary embodiment of the invention.

Please refer to FIG. 1 to FIG. 3, which shows a key cap painting tool according to an exemplary embodiment of the invention. The spray painting tool 10 is used for holding key caps 60 fixedly at specific positions so as to perform a spray painting process thereon. It is noted that the key caps 60 can be are adapted for a keyboard structure of a device selected from the group consisting of a computer, a cellular phone, and a personal digital assistant (PDA). The spray painting tool 10 is substantially a platform 20 having a plurality of protruding columns 21 formed at a top surface thereof. The plural protruding columns 21 are used for raising the key cap 60 until they are separated from the top surface of the platform 20 by a specific distance, as shown in FIG. 3. In addition, the spray painting tool 10 further comprises a panel 30, disposed on the platform 20 and having a plurality of holes 31 formed thereon at positions corresponding to the plural columns 21 for allowing the plural columns to pass through the panel therefrom so that the panel 30 is fixedly secured on the platform 20.

Figure 4A:
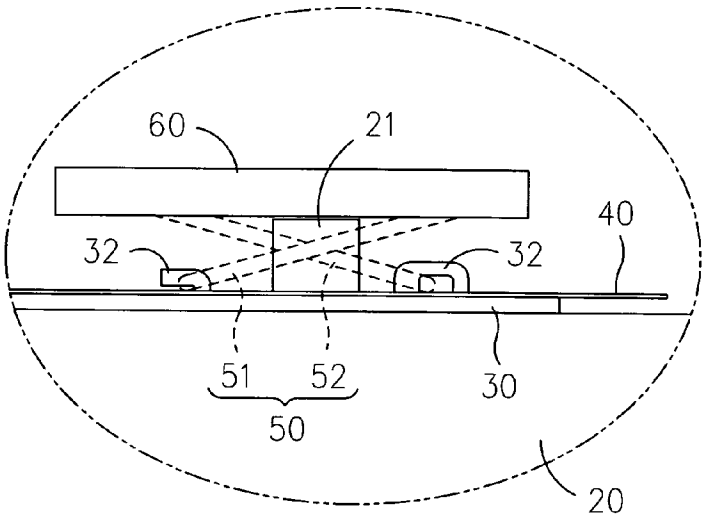
FIG. 4A is an enlarged view detailing the A portion of FIG. 4.
Figure 4:
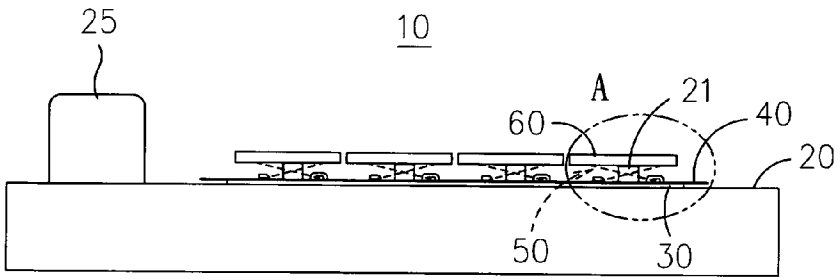
FIG. 4 is a right side view of a key cap painting tool according to an exemplary embodiment of the invention.

Moreover, there can be a plurality of interlocking mechanism 32 arranged on the panel 30, which are used for fixing scissors-shaped connecting structures (not shown in FIG. 1 to FIG. 3) on the panel 30. Please refer to FIG. 4 and FIG. 4A, which details a scissors-shaped connecting structure. In FIG. 4 and FIG. 4A, a scissors-shaped connecting structure 50 is comprised of a first connecting part 51 and a second connecting part 52, configured in a manner that the first connecting part 51 is pivotally connected with the second connecting part 52; and the bottoms of the first and the second connecting parts 51, 52 are pivotally and detachably connected to the panel 30 while the tops of the first and the second connecting parts 51, 52 are pivotally and detachably connected to the key caps 60. The disposition of such scissors-shaped connecting structures is to fixedly securing the key caps 60 to the panel 30 for preventing the key caps 60 from falling off the panel 30 during a powerful paint spraying process. The scissors-shaped connecting structure 50, similar to that used in a key with scissor-shaped frame, can provide a solid grasping force onto the key caps 60 so that it is commonly used as a holding unit for securing key caps 60 in a paint spraying process. However, it is noted that there can be other type of holding unit other than the scissors-shaped connecting structure 50 that can be used in the spray painting tool 10 only if it can fixedly holding the key caps 60 without obstructing the proceeding of a paint spraying process upon the key caps 60.

As shown in FIG. 1 to FIG. 3, a diaphragm 40 is disposed on the panel 30 in a manner that a plurality of holes 41 formed on the diaphragm 40 are aligned with the plural columns 21 for allowing the plural columns 21 to pass through the diaphragm 40 therefrom so as to fixedly secure the diaphragm 40 on the panel 30. As shown in FIG. 2, the size of the diaphragm 40 is slightly larger than that of the panel 30 while the size of the holes 41 should be slightly smaller than that of the key caps 60, and the hole 41 should be larger enough for enclosing the corresponding holes 31 of the panel 30 and the interlocking mechanisms 32 along with the protruding columns 21 therein. It is no doubt that the scissors-shaped connecting structures 50 should also be included inside the holes 41, as shown in FIG. 4. Thereby, the panel 60 can be completely covered by the key caps 60 and the diaphragm 40 so that paint used for spray painting the key caps 60 can only adhere onto the key caps 60 and the diaphragm 40 while not a drop of paint will be sprayed on the panel 30. As the diaphragm can be used repetitively and easily replaced, the diaphragm 40 can be used repetitively until the excess paint stacking on diaphragm 40 is too thick to obstruct the paint spraying process so that it is removed and replaced. The removal the old diaphragm and replacing a new diaphragm can be performed easily and quickly in the aforesaid spray painting tool 10. Moreover, the diaphragm 40 is made of a plastic selected from the group consisting of polyethylene terephthalate (PET), polyethylene (PE), polyvinyl chloride (PVC), polypropylene (PP), polystyrene (PS) and the like; and the diaphragm 40 is manufactured by a thickness of about 0.1 mm and is capable of enduring about 100° C., that is dependent upon the temperature of the baking temperature exerted on the key caps 60 after the paint spraying process.

Figure 5:
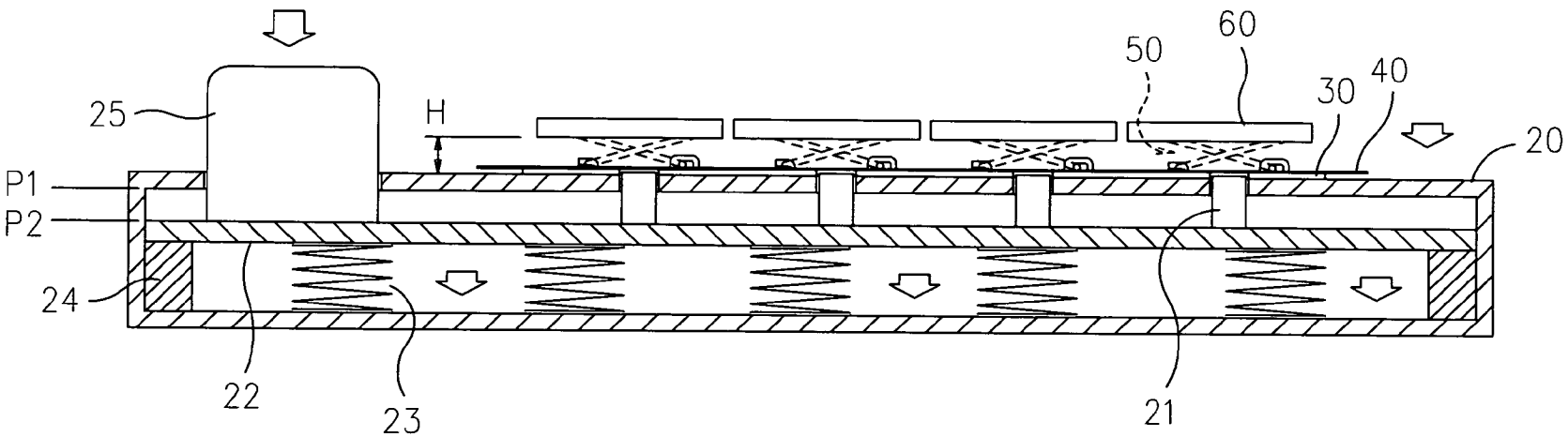
FIG. 5 is a schematic sectional diagram depicting how the protruding columns are mounted on the interlocking elements according to an exemplary embodiment of the invention.

As the disposition of the plural protruding columns 21 are used for raising the key caps 60 for separating the same from the platform 20 along with the panel 30 and the diaphragm 40 by a specific distance, the key caps 60 can be prevented from adhering with other components during the paint spraying process. The protruding columns 21 can be pillars fixedly standing on the platform 20, or can be posts connected to an interlocking element for enabling the same to descend or rise by the driving of the interlocking element. Please refer to FIG. 5, which is a schematic sectional diagram depicting how the protruding columns are mounted on the interlocking elements according to an exemplary embodiment of the invention. In FIG. 5, the bottom of each protruding column 21 bores through the platform 20 and connects to an interlocking element 22 while the interlocking element 22 is further connected to an button 25 exposed on the top surface of the platform 20. In addition, the interlocking element 22 is mounted on a plurality of springs 23 for enabling the interlocking element 22 to resiliently reciprocate between a release position P1 and a press position P2. It is noted that the plural springs 23 can be replaced by reeds or any other elastic members. The setting of the release position P1 and the press position P2 is as following: when the button 25 is released, the interlocking element 22 bounces back to the release position P1 while bring along the protruding columns 21 to rise and protrude out of the platform 20 by a specific height H which will raise the key caps 60 but not separate the same from the scissors-shaped connecting structures 50; and, when the button 25 is pressed, the interlocking element 22 is descending to the press position P2 while bring along the protruding columns to descend beneath the top surface of the platform 20 in a synchronized manner until the descending interlocking element 22 is blocked by a stop block 24. Operationally, at release position P1, those painted and baked key caps 60 can be removed from the spray painting tool 10 easily, and then the button 25 is pressed for descending the protruding columns 21 so as to facilitate the diaphragm 40 to be removed and replace.

Other than the aforesaid mechanical means for controlling the descending and rising of the protruding columns 21, such descending/rising can be controlled by the use of a control circuit (not shown in the figures), which is electrically connected to a driving device, such as a pneumatic device or a hydraulic device, however, the using of control circuit is known to those skilled in the art and thus is not described further herein.

To sum up, the present invention provides a spray painting tool for painting key caps, by which as the low-cost diaphragm can be easily replaced, the spray painting tool can be used repetitively without worrying the stacking of residue paint on its panel, and moreover, as the spray painting tool is simple in structure and ease to use, painting key caps can be achieved with lower cost and less time, so that it is adapted to manufacture keyboards for computers, cellular phones, personal digital assistants (PDAs) or the like.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A spray painting tool for painting key caps, comprising:

a platform, comprising:

a plurality of elastic members disposed inside of the platform;

an interlocking element disposed on the plurality of elastic members for enabling the interlocking element to resiliently reciprocate between a press position and a release position; and a button connected to the interlocking element;

a plurality of protruding columns mounted on the interlocking element for elevating key caps;

a panel, disposed on the platform and having a plurality of holes formed thereon at positions corresponding to the plurality of protruding columns for allowing the plurality of protruding columns to pass through the panel therefrom;

a diaphragm, disposed on the panel while aligning a plurality of holes formed thereon with the plurality of protruding columns for allowing the plurality of protruding columns to pass through the diaphragm therefrom; and at least a holding unit, being arranged on the panel at a position corresponding to the plurality of protruding columns for fixedly securing the key caps, wherein the plurality of protruding columns are mounted on the interlocking element in a manner that all of the plurality of protruding columns are driven to descend in synchronization with the descending of the interlocking element so that when the button is pressed and the interlocking element descends to the press position, all of the plurality of protruding columns are driven to descend in synchronization to be not above the top surface of the platform, and when the button is released and the interlocking element bounces back to the release position by the elastic member, the plural protruding columns are raised to protrude out of the platform.

2. The spray painting tool of claim 1, wherein the panel is covered completely by the diaphragm.

3. The spray painting tool of claim 1, wherein the diaphragm is made of a plastic selected from the group consisting of polyethylene terephthalate (PET), polyethylene (PE), polyvinyl chloride (PVC), polypropylene (PP), polystyrene (PS) and the like.

4. The spray painting tool of claim 1, wherein the holding unit is a scissors-shaped connecting structure with a first connecting part and a second connecting part, configured in a manner that the first connecting part is pivotally connected with the second connecting part; and the bottoms of the first and the second connecting parts are pivotally connected to the panel while the tops of the first and the second connecting parts are pivotally connected to the key caps in a detachable manner.

5. The spray painting tool of claim 4, wherein the bottoms of the first and the second connecting parts are pivotally connected to the panel in a detachable manner.

6. The spray painting tool of claim 1, wherein the elastic member is a device selected from the group consisting of a spring, a reed and the combination thereof.

7. The spray painting tool of claim 1, wherein the key caps are adapted for a keyboard structure of a device selected from the group consisting of a computer, a cellular phone, and a personal digital assistant (PDA).

* * * * *